United States Patent [19]

Suzuki et al.

[11] 4,442,871

[45] Apr. 17, 1984

[54] WEFT YARN GUIDE FOR A FLUID JET LOOM

[75] Inventors: Hajime Suzuki, Anjo; Yoshifumi Umemura, Toyoake; Yoshimi Iwano, Oobu; Masahiko Kimbara, Kariya, all of Japan

[73] Assignee: Kabushiki Kaisha Toyoda Jidoshokki Seisakusho, Aichi, Japan

[21] Appl. No.: 163,212

[22] Filed: Jun. 25, 1980

[30] Foreign Application Priority Data

Jun. 30, 1979 [JP] Japan ..... 54/090407[U]

[51] Int. Cl.[3] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 1,552,190 | 9/1925 | Axtell et al. | 239/565 |
| 1,791,509 | 2/1931 | Morrow | 239/565 |
| 3,139,118 | 6/1964 | Suaty | 139/435 |
| 3,847,187 | 11/1974 | Buran et al. | 139/435 |
| 4,190,067 | 2/1980 | Kuda et al. | 139/435 |

*Primary Examiner*—Henry Jaudon

*Attorney, Agent, or Firm*—Burgess, Ryan and Wayne

[57] ABSTRACT

A weft yarn guide of an air jet loom comprises a base portion capable of being connected to a sley, a pair of guide members which are connected to the upper end of the base portion and which are forked to form a weft inserting opening therebetween, a base fluid passage formed within the base portion, and a plurality of fluid blowing holes formed on the upper portions of the guide members and communicated with the base fluid passage. The weft yarn guide further comprises a branching wall projected from the upper inner wall of the base fluid passage in order to branch air flow fed from the base passage into two flows, and a pair of branch passages formed within the guide members in order to communicate the base fluid passage with the fluid blowing holes, whereby the air flow is smoothly branched without causing substantial turbulence.

5 Claims, 8 Drawing Figures

WEFT YARN GUIDE FOR A FLUID JET LOOM

FIELD TO WHICH THE INVENTION RELATES

The present invention relates to a weft yarn guide for a fluid jet loom, and especially, it pertains a weft yarn guide for an air jet loom.

BACKGROUND OF THE INVENTION

British Pat. No. 1,424,703 discloses a weft yarn guide for a jet loom which comprises: a base portion connected to a sley; a pair of guide members forked from the base portion so as to form a weft inserting opening, and; a plurality of fluid blowing holes disposed on the circumference of the pair of guide members around the weft inserting opening. In this weft yarn guide, an air flow is supplied through an air passage formed within both the base portion and the pair of guide members. When this weft yarn guide is actually used, there is a defect in that the intensities of the auxiliary air jets blown through the fluid blowing holes are not uniform therebetween, and accordingly, the weft yarn cannot be carried properly because the weft yarn is pushed upwards.

To eliminate the defect in the above-mentioned prior art apparatus, another type of weft yarn guide has been proposed, wherein fluid blowing holes are formed only on the upper surfaces of the forked guides members, so that air jets which may push up the weft yarn are omitted. However, in this weft yarn guide, no consideration is given to the design of the air passage formed within the base portion and the pair of guide members, especially at the junction of the base portion and the pair of guide members, and accordingly, air flow fed from the base portion impinges upon the upper inner wall of the air passage at the junction and causes turbulences, and as a result, the intensities of the auxiliary air jets blown through the fluid blowing holes cannot be uniform.

SUMMARY OF THE INVENTION

An object of the present invention is to provide a weft yarn guide for a fluid jet loom, by which flow resistance to the fluid flow can be minimized and the intensities of the auxiliary fluid jets blown through the fluid blowing holes can be uniform, and accordingly, the insertion of the weft yarn can assuredly and smoothly be effected.

According to the present invention, the above mentioned object is achieved by a weft yarn guide for a fluid jet loom comprising: a base portion capable of being connected to a sley; a pair of guide members which are connected to the upper end of the base portion and which are forked to form a weft inserting opening therebetween; a base fluid passage formed within the base portion, and; a plurality of fluid blowing holes which are formed on the surface of the forked guide members, except for the lower surfaces thereof, and which are communicated with the base fluid passage. The weft yarn guide according to the present invention is characterized in that: a branching wall is projected from the upper inner wall of the base fluid passage so that fluid flow fed from the base fluid passage is branched into two flows, and; a pair of branch passages, the lower ends of which are communicated with the base fluid passage and which are communicated with the fluid blowing holes formed on the forked guide members, are formed within said guide members, so that the branched flows are blown through the fluid blowing holes.

BRIEF DESCRIPTION OF THE DRAWINGS

Disadvantages of the prior art devices and some embodiments of the present invention will now be explained in detail with reference to the accompanying drawings, wherein.

DETAILED DESCRIPTION OF THE INVENTION

Prior to the explanation concerning the embodiments of the present invention, some weft yarn guides belonging to the prior art will be explained, with reference to FIGS. 1 through 3, in order to clarify the defects of the conventional weft yarn guides.

Figure 1:
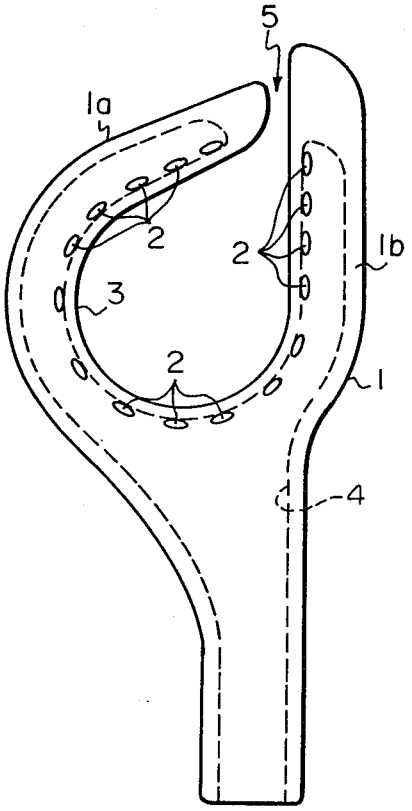
Fig. 1 PRIOR ART
FIG. 1 is an elevational view of a conventional weft yarn guide.

In a conventional closed type weft yarn guide 1 for a fluid jet loom illustrated in FIG. 1, an annular body 3 is formed by an arced guide member 1*a* of the weft yarn guide 1 and an upright guide member 1*b* of the weft yarn guide 1, and the annular body has an inner circumference which faces the weft yarn inserting direction. A plurality of fluid blowing holes 2 for blowing auxiliary air jets are formed on the inner circumference. As a result, the fluid blowing holes 2 serve to blow auxiliary air jets in the weft inserting direction by utilizing air fed through an air passage 4 formed within the weft yarn guide 1. In this case, the air jets are so blown that they surround the entire outer periphery of a main air flow which is flowed from a main nozzle (not shown) in the weft inserting direction. However, in this weft yarn guide, the air flow fed from the air passage 4 is directly blown through the fluid blowing holes 2 which are formed at the lower portion adjacent to the base portion of the weft yarn guide 1, and accordingly, the intensity of the auxiliary air jets blown through these lower fluid blowing holes 2 becomes stronger than the intensity of the auxiliary air jets blown through the other fluid blowing holes 2 located on the upper surfaces of the guide members 1*a* and 1*b*. As a result, a weft yarn passing through a weft inserting opening surrounded by the guide members 1*a* and 1*b* is pushed upwards towards a slit 5 of the weft yarn guide 1, and the weft yarn cannot correctly be carried in the inserting direction. Consequently, there is a defect in this yarn guide in that the weft yarn is sometimes pushed out through the slit 5 and the weaving operation cannot be continued.

To eliminate the above-mentioned defect, an improvement has been proposed, wherein the inner diameter of the fluid blowing holes 2 located at the lower portion is made smaller than the other fluid blowing holes 2, so that the intensities of the air jets blown through all the fluid blowing holes are uniform. However, adjustment of the sizes of the fluid blowing holes in accordance with this proposal is difficult, and its application to actual devices is impossible.

Figure 2:
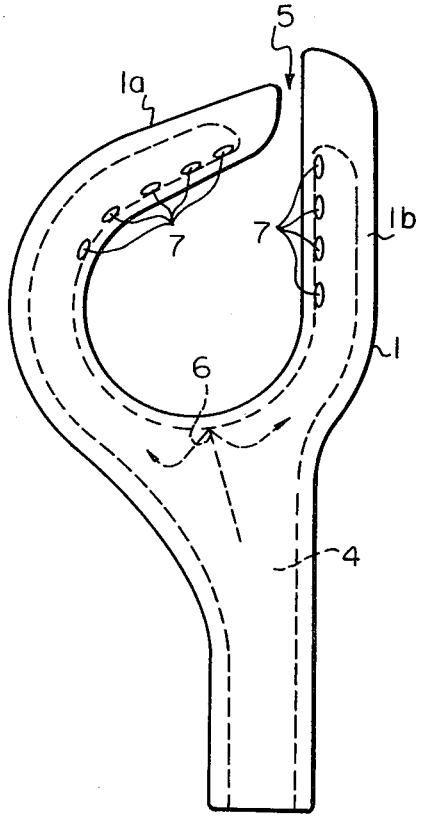
Fig. 2 PRIOR ART
FIGS. 2 and 3 are elevational and partial cross sectional views of another conventional weft yarn guide.
Figure 3:
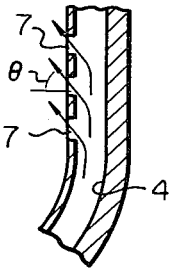
Fig. 3 PRIOR ART

Another weft yarn guide has been also proposed to eliminate the above-mentioned defect, in which guide the lower fluid blowing holes 2 (FIG. 1) which may blow auxiliary air jets with high tensity are omitted as illustrated in FIG. 2. However, in this weft yarn guide 1, air flow fed from an air passage 4 formed within the base portion directly impinges upon an inner upper wall 6 of the air passage 4, and, then, is dispersed. Accordingly, the flow speed of the air flow is reduced and the air flow generates turbulence therein, and thereafter, the air flow containing turbulence is fed to fluid blowing holes 7 located in the upper portion of the guide 1. Because of the turbulence, the flow resistance of the air flow becomes large, and the intensities of the auxiliary air jets blown through the fluid blowing holes cannot be uniform. In addition, it should be noted that, as illustrated in FIG. 3, the auxiliary air jets blown through the fluid blowing holes 7 are blown upwards forming a large angle $\theta$ of attack from the horizontal plane because the fluid flows straight due to its momentum, and that, accordingly, a similar defect to that of the guide illustrated in FIG. 1, that the weft yarn is pushed upwards, is caused.

The first embodiment of a weft yarn guide for a fluid jet loom, which is constructed as a weft yarn guide for an air jet loom, according to the present invention will now be explained in detail with reference to FIGS. 4 through 7. Reference numeral 10 in FIG. 4 generally denotes a weft yarn guide, which comprises a base portion 11 adapted to be connected to a sley (not shown), an arced guide member 12 branched from the upper end of the base portion 11 and extending towards the woven fabric (not shown), and an upright guide member 13 branched also from the upper end of the base portion 11 and extending upwards so as to face the arced guide member 12. A circular weft yarn inserting opening 14 is formed by the arced guide member 12 and the upright guide member 13, and a slit 15 is formed between the upper ends of the arced guide member 12 and the upright guide member 13, so that the picked weft yarn (not shown) can be passed outwards through the slit 15 when the weft yarn guide 10 is swung toward the woven fabric in order to beat the reeds (not shown).

A base fluid passage 16 is formed within the base portion 11, and the upper inner walls of the fluid passage 16 are so formed that there is formed a branching wall 17, which converges in the direction of the bottom of the base portion 11 and which branches the base fluid passage 16 into a branch passage 18 formed within the arced guide member 12 and a branch passage 19 formed within the upright guide member 13. The branching wall 17 has such a thickness that the branch passages 18 and 19 formed within the arced guide member 12 and the upright guide member 13, respectively, are deviated towards the outer side of the arced and upright guide members 12 and 13 respectively. In addition, the ratio of the cross sectional areas of the branch passages 18 and 19 at their lower ends 18*a* and 19*a* where they are connected to the base fluid passage 16 is determined based on the ratio of the areas of fluid blowing holes 21 and 23, as will be explained later, so that the intensities of the auxiliary air jets blown through the fluid blowing holes 21 and 23 becomes uniform.

Figure 4:
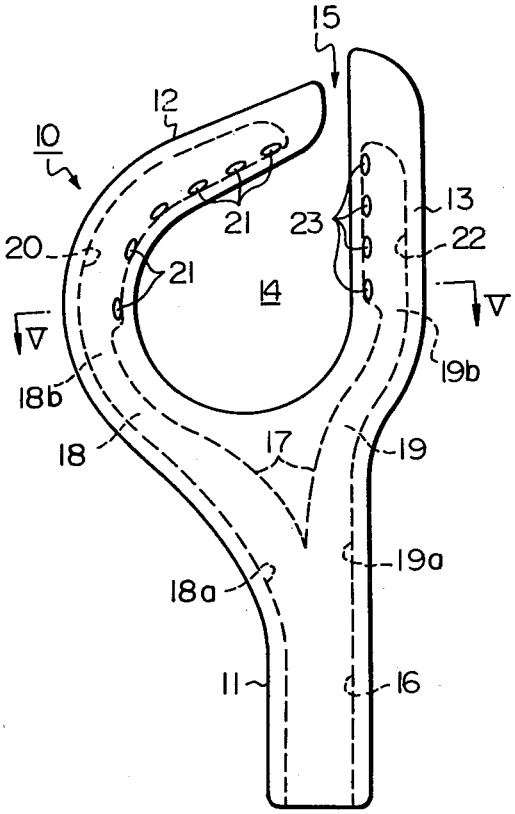
FIG. 4 is an elevational view of a weft yarn guide according to the present invention.
Figure 5:
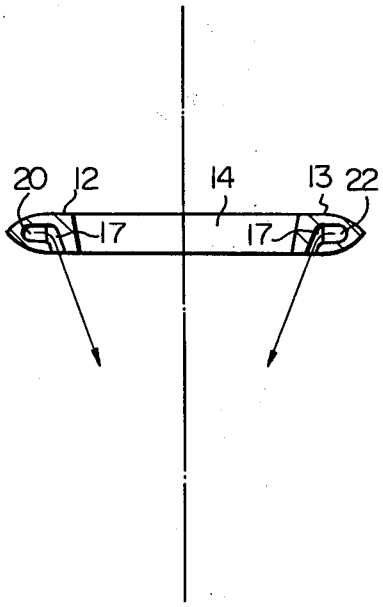
FIG. 5 is a cross sectional view taken along line V—V in FIG. 4.
Figure 7:
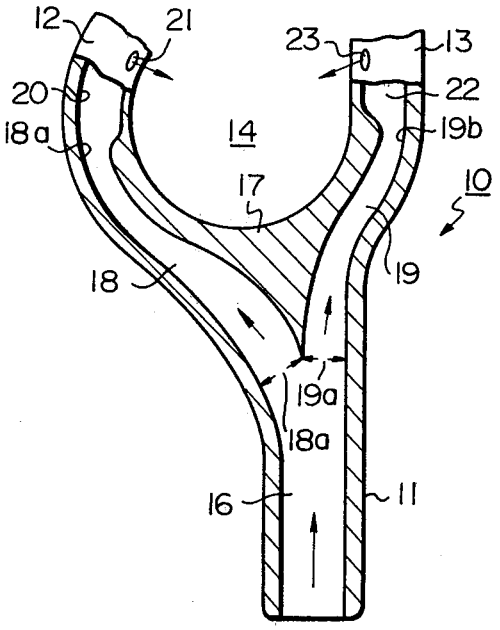
FIG. 7 is a cross sectional view of the guide illustrated in FIG. 4, wherein upper part is omitted.

A fluid chamber 20 is formed within the upper portion of the arced guide member 12 and is communicated with the upper end 18*b* of the branch passage 18, which is formed within the arced guide member 12. As illustrated in FIG. 7, the inner diameter of the fluid chamber 20 is larger than that of the branch passage 18 formed within the arced guide member 12, because the inner wall of the fluid chamber 20 bulges towards the inner wall of the arced guide member 12. A plurality of fluid blowing holes 21, six in the illustrated embodiment, are formed on the inner surface of the arced guide member 12, which surface faces the weft inserting direction, as illustrated in FIGS. 4 and 5, so that air flow fed from the base fluid passage 16 and branched into the branch passage 18 and the fluid chamber 20 formed within the arced guide member 12 is blown as auxiliary air jets through the six fluid blowing holes 21 towards the central axis of the weft inserting opening 14.

Figure 6:
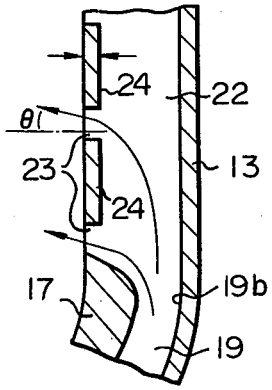
FIG. 6 is an enlarged cross sectional view of a part of the guide illustrated in FIG. 4.

A fluid chamber 22 is formed within the upper portion of the upright guide member 13 and is communicated with the upper end 19*b* of the branch passage 19, which is formed within the upright guide member 13. As illustrated in FIGS. 6 and 7, the inner diameter of the fluid chamber 22 is larger than that of the branch passage 19 formed within the upright guide member 13, because the inner wall of the fluid chamber 22 bulges towards the inner wall of the upright guide member 13. A plurality of fluid blowing holes 23, four in the illustrated embodiment, are formed on the inner surface of the upright guide member 13, which surface faces the weft inserting direction, as illustrated in FIGS. 4 and 5, so that air flow fed from the base fluid passage 16 and branched into the branch passage 19 and the fluid chamber 22 formed within the upright guide member 13 is blown as auxiliary air jets through the four fluid blowing holes 23 towards the central axis of the weft inserting opening 14.

The first embodiment according to the present invention operates as follows. The air flow fed through the base fluid passage 16 is smoothly branched by the branching wall 17 into the branch passage 18 formed within the arced guide member 12 and the branch passage 19 formed within the upright guide member 13 without encountering any substantial resistance, and the branched air flows are blown through the fluid blowing holes 21 and 23. Accordingly, when the air flow is branched, the air flow speed is not reduced and turbulence is not introduced into the air flow or the effects are reduced from those caused by conventional guides. The flow resistance can be minimized.

In addition, the ratio of the cross sectional area of the branch passage 18 at its lower end 18*a*, which passage is formed within the arced guide member 12, to the cross sectional area of the branch passage 19 at its lower end 19*a*, which passage is formed within the upright guide member 13, is so selected that it corresponds to the ratio of the total area of the fluid blowing holes 21 formed on the arced guide member 12 to the total area of the fluid blowing holes 23 formed on the upright guide member 13, and accordingly, the intensities of the auxiliary air jets blown through the fluid blowing holes 21 and 23 can be uniform.

Furthermore, as illustrated in FIG. 6, since the inner surface of the upper end 19*b* of the branch passage 19 formed within the upright guide member 13 is separated from the fluid blowing holes 23 formed on the inner surface of the fluid chamber 22 formed within the upright guide member 13 because of the thickness of the branching wall 17, the air flow flowing from the branch passage 19 is bent to the fluid blowing holes 23, and accordingly, the angle $\theta$ of attack of the auxiliary air jets blown through the fluid blowing holes 23 is less than that generated by the above-mentioned conventional weft yarn guide. Regarding the angle of attack of the auxiliary air jets, if the thickness of the inner wall on which the fluid blowing holes 23 are formed is increased to a certain amount which does not create excessive flow resistance, the angle $\theta$ of attack of the auxiliary air jets can be further be decreased. The above discussion is also applicable to the branch passage 18 formed within the arced guide member 12 and the fluid blowing holes 21 formed on the arced guide member 12.

The present invention is not limited to the above-explained first embodiment, and various modifications or improvements can be effected to the first embodiment, for example, as described in the explanation of the second embodiment, below, within the scope of the present invention which is defined in the attached claims.

Figure 8:
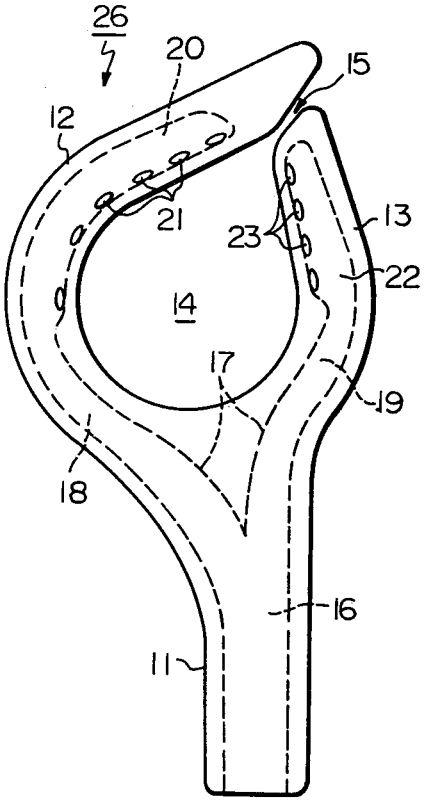
FIG. 8 is an elevational view of another weft yarn guide according to the present invention.

A second embodiment of the weft yarn guide according to the present invention is illustrated in FIG. 8, wherein the upright guide member 13 utilized in the first embodiment is inclined inwards, so that a weft yarn guide 26 is obtained.

According to the present invention, the flow resistance of the air flow can be minimized, and at the same time the intensities of the auxiliary air jets blown through the fluid blowing holes can be uniform, and accordingly, the insertion of the weft yarn can assuredly and smoothly be effected. Therefore, the weft yarn guide according to the present invention has a remarkable advantage when it is used in an air jet loom.

We claim:

1. A weft yarn guide for a fluid jet loom comprising:

a base portion capable of being connected to a sley;

a pair of guide members which are connected to the upper end of said base portion and which are forked to form a weft inserting opening therebetween;

a base fluid passage formed within said base portion, and;

a plurality of fluid blowing holes which are formed on the upper surface of said forked guide members but are not formed on the lower surface of said forked guide members and which are communicated with said base fluid passage, characterized in that said guide further comprises:

a branching wall which projects from the upper inner wall of said base fluid passage toward the inside of said fluid passage, and;

a pair of branch passages, the lower ends of which communicate with said base fluid passage and which communicate with said fluid blowing holes.

2. A weft yarn guide for a fluid jet loom comprising:

a base portion capable of being connected to a sley;

a pair of guide members which are connected to the upper end of said base portion and which are forked to from a weft inserting opening therebetween;

a base fluid passage formed within said base portion, and;

a plurality of fluid blowing holes which are formed on the upper surface of said forked guide members but are not formed on the lower surface of said forked guide members and which are communicated with said base fluid passage, characterized in that said guide further comprises:

a branching wall which projects from the upper inner wall of said base fluid passage toward the inside of said fluid passage, and;

a pair of branch passages, the lower ends of which communicate with said base fluid passage and which communicate with fluid blowing holes wherein the ratio of the cross sectional areas of said pair of branch passages at said lower ends corresponds to the ratio of the areas of said fluid blowing holes formed on respective forked guide members, so that the intensities of auxiliary fluid jets blown through said fluid blowing holes are uniform.

3. A weft yarn guide of claim 2 further comprising fluid chambers formed within said forked guide members behind said fluid blowing holes, said chambers being in communication with said blowing holes and with the upper ends of said branch passages at said upper ends, said walls being located near said weft inserting opening, are separated from said fluid blowing holes, whereby the angle of attack of auxiliary fluid jets passing through said fluid blowing holes is small.

4. A weft yarn guide of a fluid jet loom of claim 1 or 2, wherein said branching wall converges towards said base fluid passage, whereby fluid flowing from said base fluid passage smoothly branches into said pair of branch passages without causing substantial turbulence within said flowing fluid.

5. A weft yarn guide for a fluid jet loom comprising:

a base portion capable of being connected to a sley;

a pair of guide members which are connected to the upper end of said base portion and which are forked to form a weft inserting opening therebetween;

a base fluid passage formed within said base portion, and;

a plurality of fluid blowing holes which are formed on the upper surface of aid forked guide members but are not formed on the lower surface of said forked guide members and which are communicated with said base fluid passage, characterized in that said guide further comprises:

a branching wall which projects from the upper inner wall of said base fluid passage toward the inside of said fluid passage, and;

a pair of branch passages, the lower ends of which communicate with said base fluid passage and which communicate with said fluid blowing holes further comprising fluid chambers formed within said forked guide members behind said fluid blowing holes said chambers are in communication with the blowing holes and with the upper ends of said branch passages at said upper ends, which walls are located near said weft inserting opening, are separated from said fluid blowing holes, whereby the angle of attack of auxiliary fluid jets passing through said fluid blowing holes is small.

* * * * *